US006651298B2

(12) United States Patent
Fromson et al.

(10) Patent No.: US 6,651,298 B2
(45) Date of Patent: Nov. 25, 2003

(54) BRUSH GRAINING METHOD

(75) Inventors: Howard A. Fromson, 43 Main St., Stonington, CT (US) 06378; William J. Rozell, Vernon, CT (US)

(73) Assignee: Howard A. Fromson, Stonington, CT (US)

( * ) Notice: Subject to any disclaimer, the term of this patent is extended or adjusted under 35 U.S.C. 154(b) by 0 days.

(21) Appl. No.: 10/346,606

(22) Filed: Jan. 17, 2003

(65) Prior Publication Data

US 2003/0131747 A1 Jul. 17, 2003

Related U.S. Application Data

(63) Continuation of application No. 09/592,354, filed on Jun. 12, 2000, now abandoned.

(51) Int. Cl.[7] ..... B24B 39/00
(52) U.S. Cl. ..... 29/90.3; 29/90.01; 29/90.5
(58) Field of Search ..... 29/90.3, 90.01, 29/90.5, 89.5, 81.12; 451/10, 11, 67, 207, 446, 80, 94; 72/39

(56) References Cited

U.S. PATENT DOCUMENTS

| | | | | |
|---|---|---|---|---|
| 2,680,938 A | | 6/1954 | Peterson | 51/5 |
| 3,637,359 A | | 1/1972 | Malloy et al. | 51/298 |
| 3,811,227 A | * | 5/1974 | Petrik | 51/16 |
| 4,063,063 A | * | 12/1977 | Funck et al. | 219/121 |
| 6,273,784 B1 | | 8/2001 | Yamazaki et al. | 451/10 |

* cited by examiner

*Primary Examiner*—John C. Hong
(74) *Attorney, Agent, or Firm*—Alix, Yale & Ristas, LLP

(57) ABSTRACT

A lithographic printing plate substrate web is brush grained with some of the brushes having the bristles moving over the web along a first track and some additional brushes having the bristles moving over the web along a second track at an angle of at least 5° to the first track. Some of the brushes may have the axis of rotation perpendicular to the direction of movement of the web in the conventional manner and at least one additional brush having the axis of rotation at an angle to the direction of movement of the web. There may be a plurality of such additional brushes, usually two, with the additional brushes being angled with respect to each other. In one embodiment, the bristles of the additional brush track over the web in a direction perpendicular to the web movement.

8 Claims, 12 Drawing Sheets

BRUSH GRAINING METHOD

This application is a continuation of application Ser. No. 09/592,354 filed Jun. 12, 2000, now abandoned.

BACKGROUND OF THE INVENTION

This invention relates to the roughening of a smooth planar metal surface and particularly to the roughening of an aluminum lithographic printing plate substrate by brush graining of an aluminum web.

The art of lithographic printing depends upon the immiscibility of oil and water and the preferential retention of an oily image-forming ink on the image areas and an aqueous dampening fluid on the non-image areas. The lithographic printing plate has a radiation sensitive oleophilic coating that is applied and adhered to the aluminum substrate. When exposed to the imaging radiation and developed, the oleophilic coating remains in the areas to be inked and is removed in the non-printing areas. Where the coating is removed, the hydrophilic substrate is revealed.

In the preparation of a lithographic printing plate substrate, it is desirable to provide a surface which is adherent to the coating, which is highly hydrophilic and which is abrasion resistant. This usually involves anodizing the surface of the aluminum which is sometimes followed by a silicating treatment. The anodizing of the aluminum substrate for lithographic printing plates is well known and, for example, is described in U.S. Pat. No. 3,181,461.

Prior to anodizing, it is a common practice to grain the surface of the aluminum substrate. This is a surface roughening operation which increases the surface area, promotes adhesion of the coating to the substrate and provides for an increased water retention capacity. One such graining technique is rotary brush graining in which a slurry of fine graining particles abrade the surface of the aluminum under the action of rotary brushes. For a teaching of rotary brush graining, see U.S. Pat. No. 4,183,788. In a typical operation an aluminum web is moved through the graining apparatus at the rate of perhaps 100 to 120 feet per minute. A series of brushes having nylon bristles about two inches long are mounted transversely across the web such that the bristles engage and move over the web in the direction of travel of the web. The slurry of graining particles, typically aluminum oxide, is delivered onto the web prior to the brushes. The brushes are rotated at speeds which produce a velocity at the tip of the bristles of up to 2,000 feet per minute or more. The action of the brushes over the surface of the web moves the graining particles along the web surface in the direction of the movement of the web. The result of this arrangement for rotary brush graining is that there is a propensity or proclivity for the roughening to form minute ridges or striations extending along the web in the direction of web movement. In addition to being visibly objectionable, the surface topography is less than ideal in terms of peaks and valleys. A mapping of the surface topography by optical interferometry showing the ratio of peaks to valleys as a function of the mid point between the highest peaks and lowest valleys indicates a preponderance of peaks. This is detrimental to water retention, which occurs in the valleys, and to the ink/water balance. It also requires thicker plate coatings to cover the peaks and retain that coverage as the coatings wear down during usage.

SUMMARY OF THE INVENTION

The object of the invention is to brush grain the aluminum substrate of a lithographic printing plate in a manner which will reduce striations or ridges produced by prior art brush graining. The invention involves brush graining with a plurality of brushes with the track of the movement of the bristles of at least one brush over the web surface being at an angle to the track of the movement of the bristles of one or more other brushes over the web surface.

DESCRIPTION OF THE PREFERRED EMBODIMENT

Figure 1:
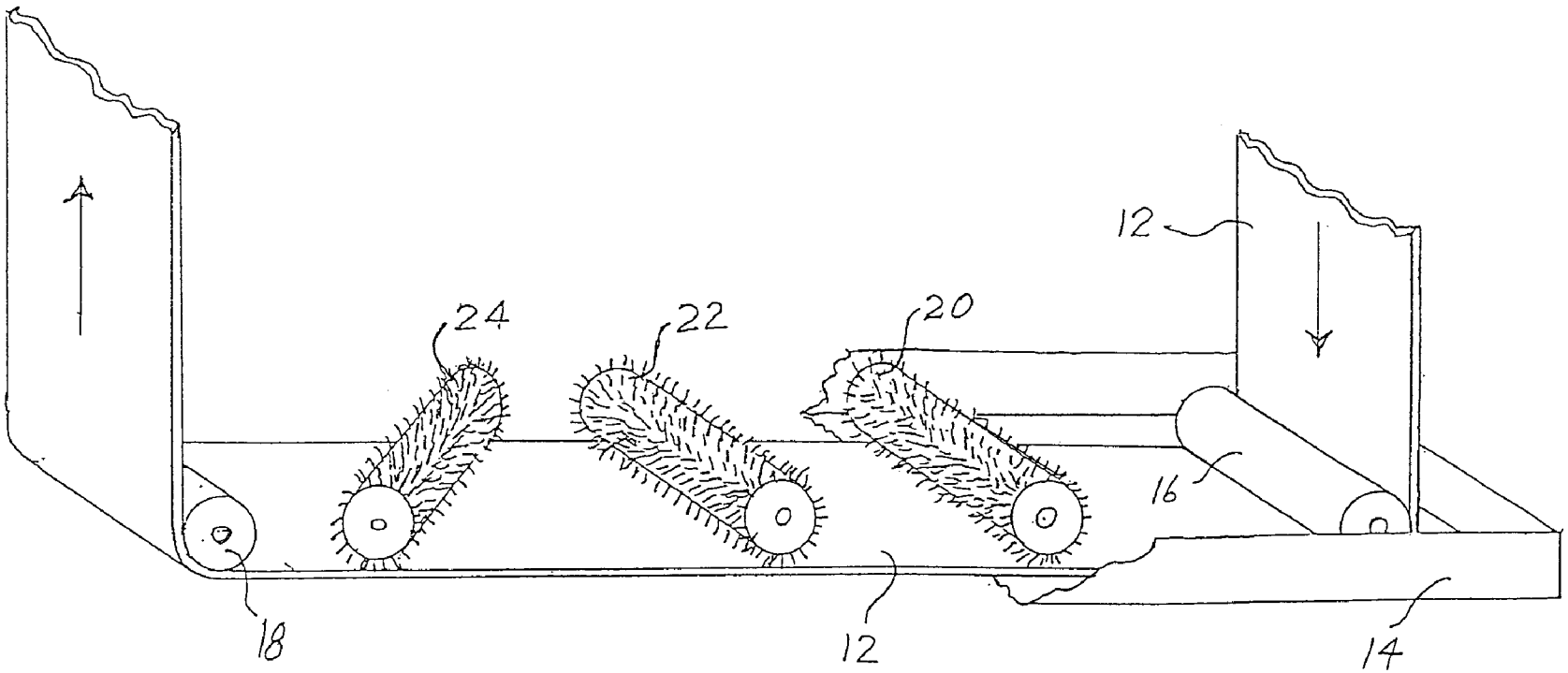
FIG. 1 is a perspective view of a brush graining system showing one embodiment of the orientation of the brushes according to the invention.

FIG. 1 is a representation of a brush graining operation with the web of aluminum 12 being fed into and out of the slurry trough 14 around the guide rollers 16 and 18. A typical web speed is 100 to 120 feet per minute. The rotary brushes 20 and 22 are conventional graining brushes typically having nylon bristles about two inches long. These brushes are driven (drive means not shown), for example, at a rate which produces a bristle tip velocity of 2,000 feet per minute or more. The brushes 20 and 22 are mounted in the conventional manner with the axis of rotation extending transversely across the web 12. It can be seen that the movement or track of the bristles along the web surface is longitudinal or in the direction of web movement. Although only two of these typical brushes 20 and 22 have been illustrated, a normal brush graining operation might have as many as eight such brushes. Also, one or more of the brushes may rotate in the general direction opposite to the web movement. It should be obvious to one skilled in the art that the optimum web speed and bristle tip velocity are dependent on several factors, such as hardness and particle size of the abrasive, bristle type (e.g., thickness, length, material), number of brushes in the graining device and specific topography desired for the grained sheet. The values for web speed and bristle tip velocity given herein are known useful values in the graining equipment used for the preparation of the examples described, and do not in any way limit the usefulness of the present invention at web speeds and bristle tip velocities other than those given as typical conditions.

In accordance with the invention, one or more additional brushes are incorporated with these additional brushes oriented at angles with respect to the brushes 20 and 22 and optionally at angles to each other. In FIG. 1, there is one additional brush 24. The brush 24 itself is the same as or similar to the brushes 20 and 22 but it is mounted for rotation at an angle to the direction of travel of the web and at an angle to brushes 20 and 22. It can be seen that the track of the bristles of the brush 24 over the web surface is no longer longitudinal. The track of these bristles is at an angle to the direction of web travel and at an angle to the track of the bristles of brushes 20 and 22. Consequently, these bristles and the graining particles move across any longitudinal ridges or striations that have been formed by the brushes 20 and 22. This action has the effect of breaking up or forming gaps in the ridges or striations and thereby forming more valleys compared to peaks. This result is confirmed by optical interferometry showing a preponderance of valleys. Also, ridges or striations are now less visible.

Figure 2:
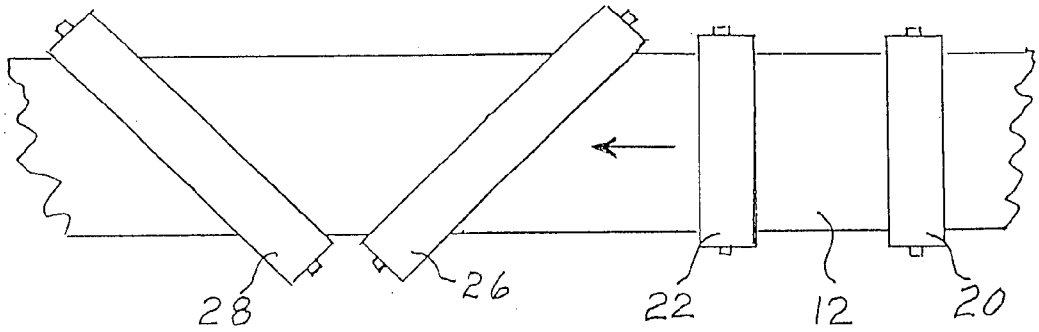
FIG. 2 is a diagrammatic representation of another brush orientation according to the invention.

FIG. 2 is a plan view of an embodiment in which there are two additional brushes 26 and 28 with these two brushes being at an angle to each other and at opposite angles to the direction of travel of the web. This angled two-brush arrangement tends to even further obliterate any ridges or striations. Another embodiment of the invention is a variation in which the graining brushes are all at angles to the direction of travel of the web and wherein at least two such angled brushes are at angles to each other. In other words, there are no brushes mounted with the axis of rotation extending transversely across the web. This is a variation of the FIG. 2 embodiment with the elimination of the brushes 20 and 22. In any of these embodiments, one or more of the brushes may be rotated in the direction opposite to the web movement although that is not the preferred direction of rotation.

Figure 3:
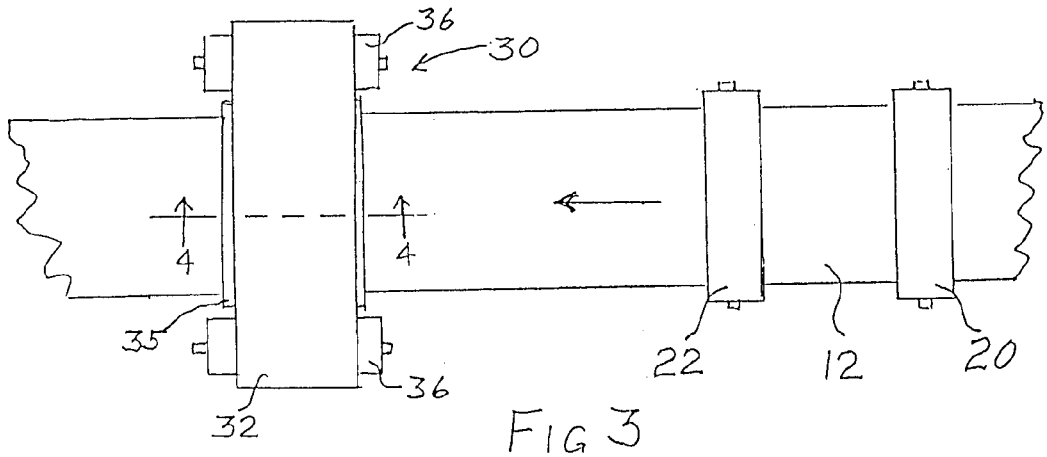
FIG. 3 is a plan view of a further embodiment of the invention employing a brushing mechanism adapted to move the bristles transversely across the moving web.
Figure 4:
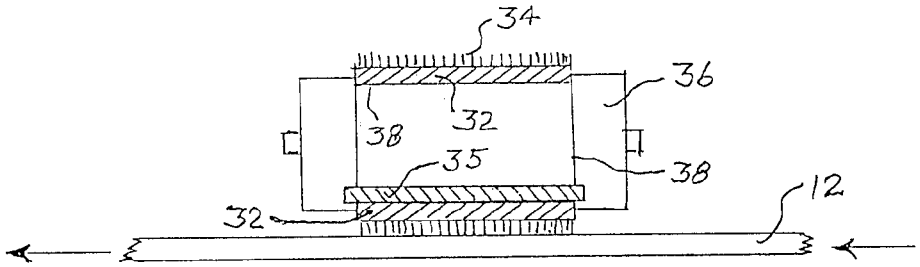
FIG. 4 is a cross-section view of a portion of FIG. 3 taken along line 4—4 further illustrating the transverse brushing mechanism.

FIG. 3 of the drawings is a plan view and FIG. 4 is a cross section view of a further embodiment of the invention employing a brushing mechanism which moves the bristles transversely across the path of the web. First, the web is brush grained with the rotary brushes and 22 just as in the previous embodiments. This is followed by the brush graining mechanism generally designated 30. This mechanism comprises a flexible belt 32 of rubber or some synthetic in which the brush bristles 34 are anchored. The belt 32 extends generally transversely across the web 12 at an angle to the direction of travel of the web and is held in contact with the web by the back-up plate 35. The belt 32 extends around the two cylinders or sheaves 36, one of which is driven (drive means not shown). The belt 32 is maintained in position by the groove 38 in the sheaves 36. As can be seen, the bristles 34 move transversely across the path of the web. The track of the bristles with respect to the moving web itself will be almost transverse across the web since the brush is moving very rapidly and the web is moving slowly. The belt 32 can be perpendicular to the direction of travel of the web as shown or it can be at an angle other than perpendicular.

Figure 5:
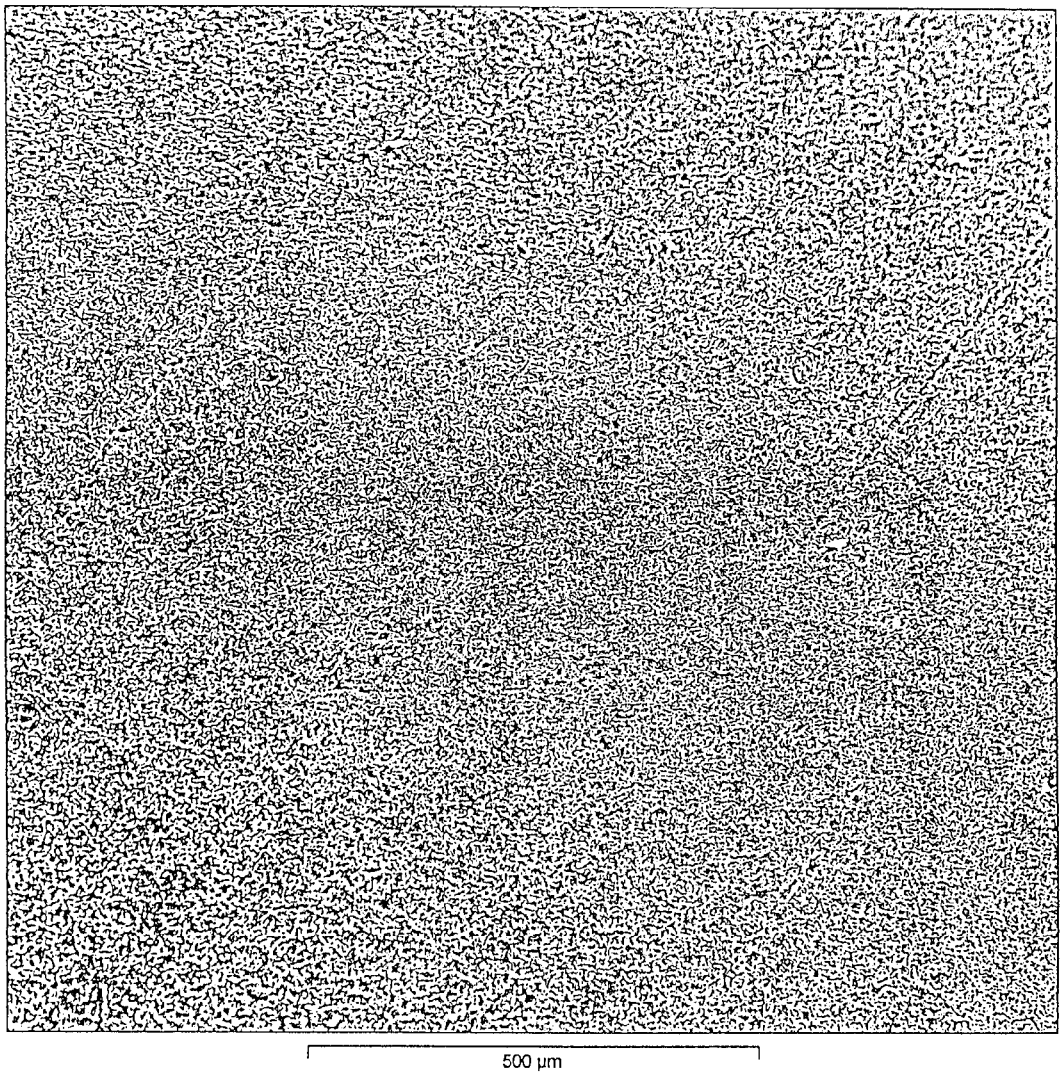
FIGS. 5 to 14 are micrographs of brush grained surfaces at different magnifications comparing a conventional brush grained plate with plates brush grained according to the invention.
Figure 6:
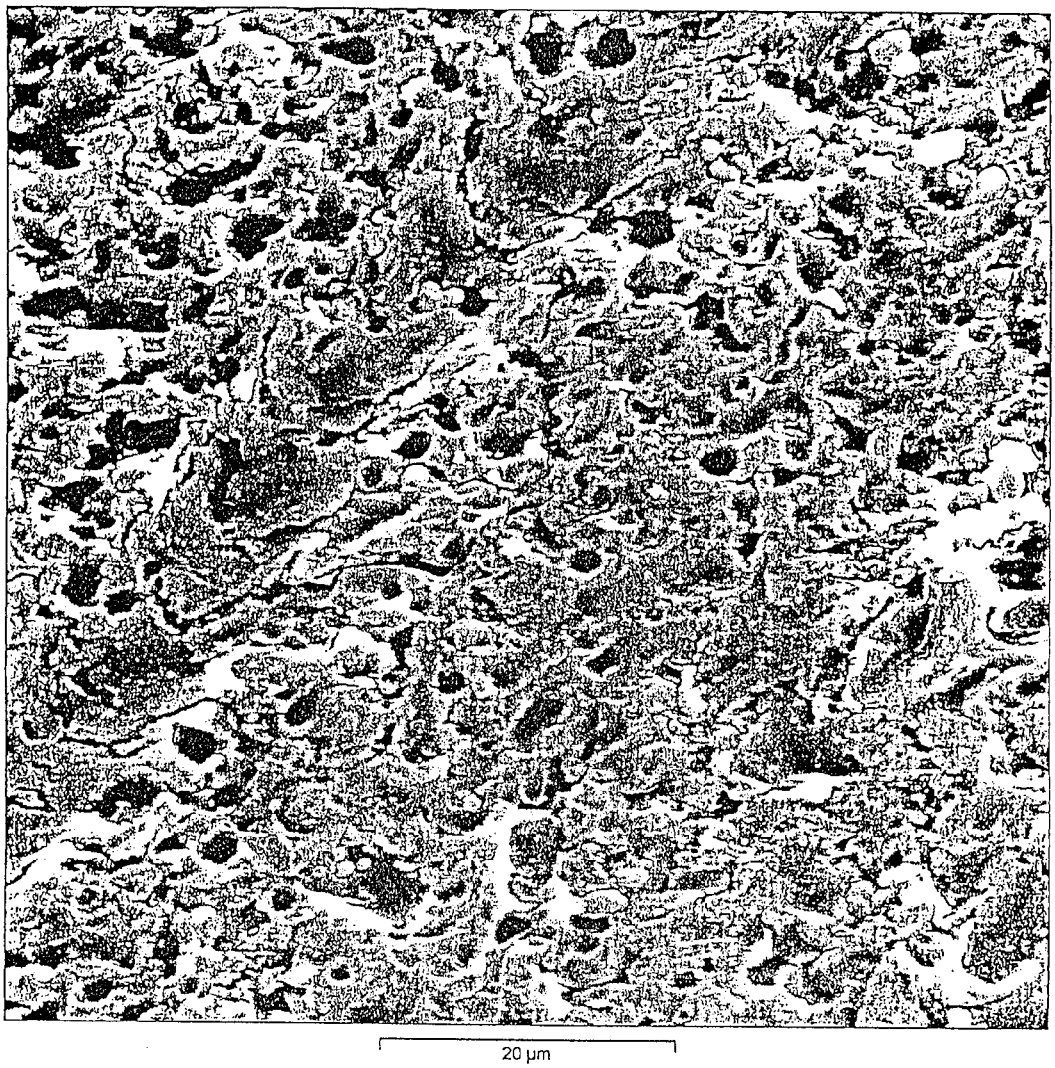
Figure 7:
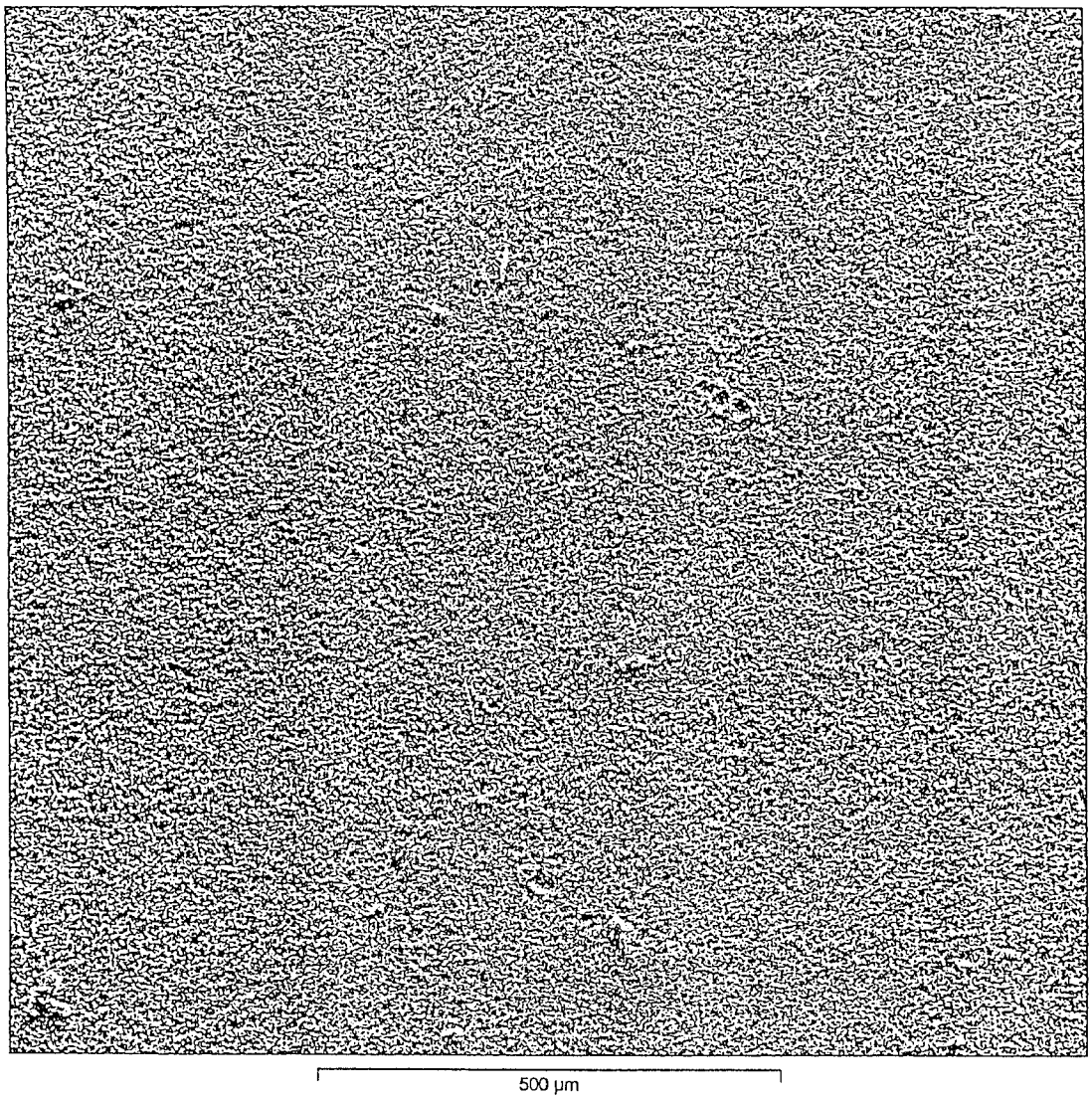
Figure 8:
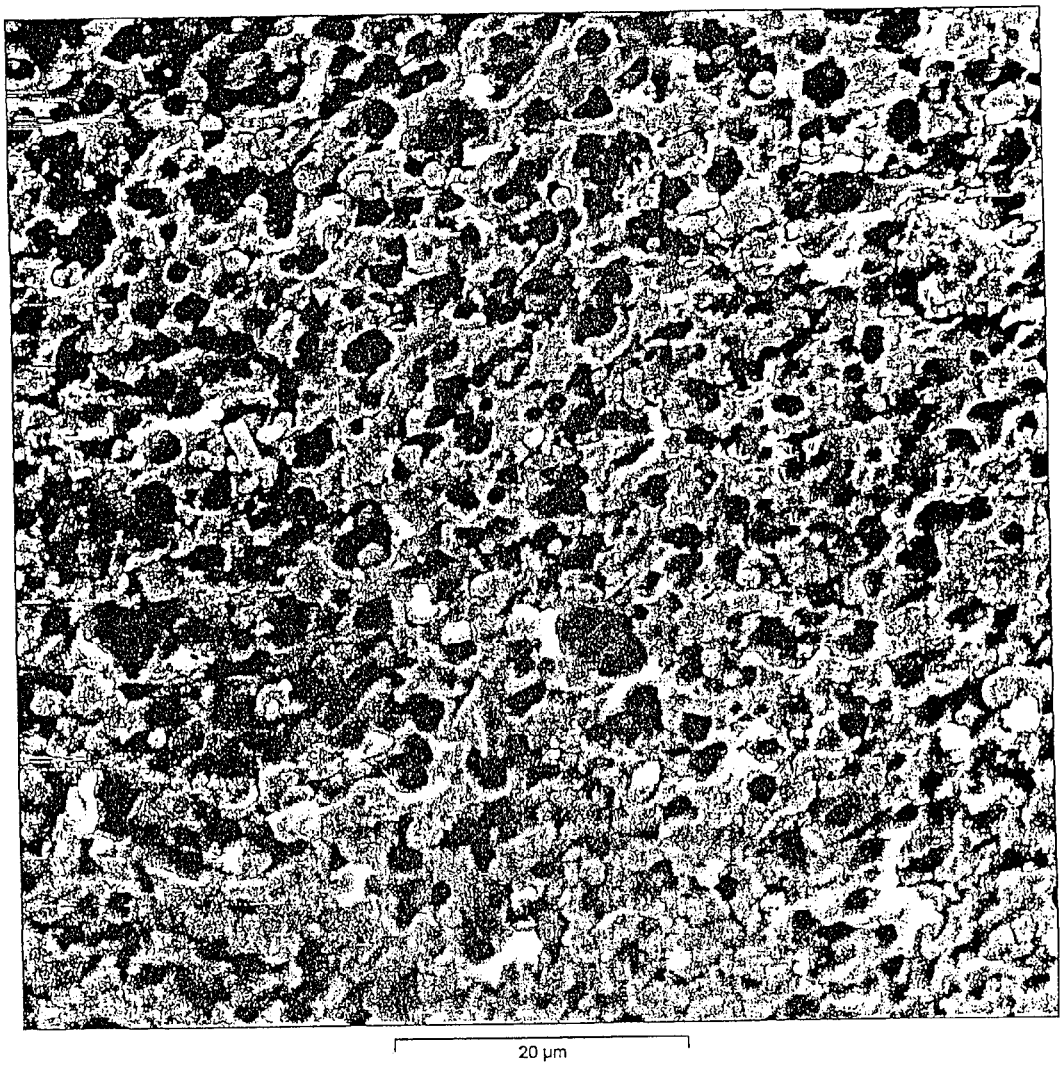

FIGS. 5 to 14 illustrate the effects of the invention on the typography of the surfaces. These are micrographs of aluminum plates which have been brush grained and then etched and anodized as would be done in a typical lithographic printing plate manufacturing process. FIGS. 5 and 6 show two different magnifications of a plate which was brush grained by the typical prior art process with the axis of rotation of the brushes being perpendicular to the direction of web movement. The scale is indicated on each figure. In these two figures, the striations caused by the prior art brush graining are evident and it can be clearly seen that there is a common directionality to these striations. In FIG. 5 the striations run from the upper right to the lower left and in FIG. 6 one prominent striation can be seen running from the upper central portion to the lower left area. For comparison, the FIGS. 7 to 14 illustrate brush graining according to the invention in which conventionally grained samples are than further grained as follows:

FIGS. 7 and 8

1 pass at 45° to original graining direction 1 pass at the opposite 45° angle

Figure 9:
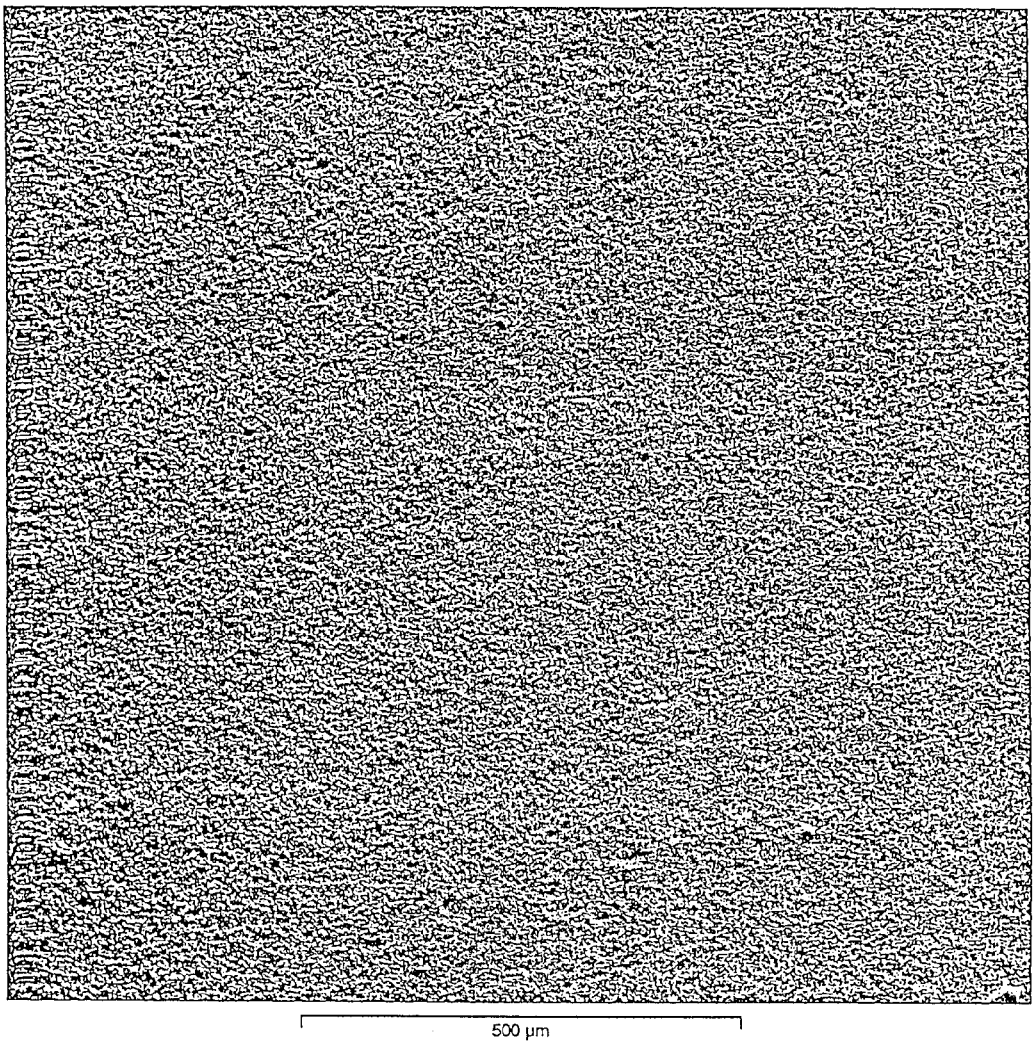
Figure 10:
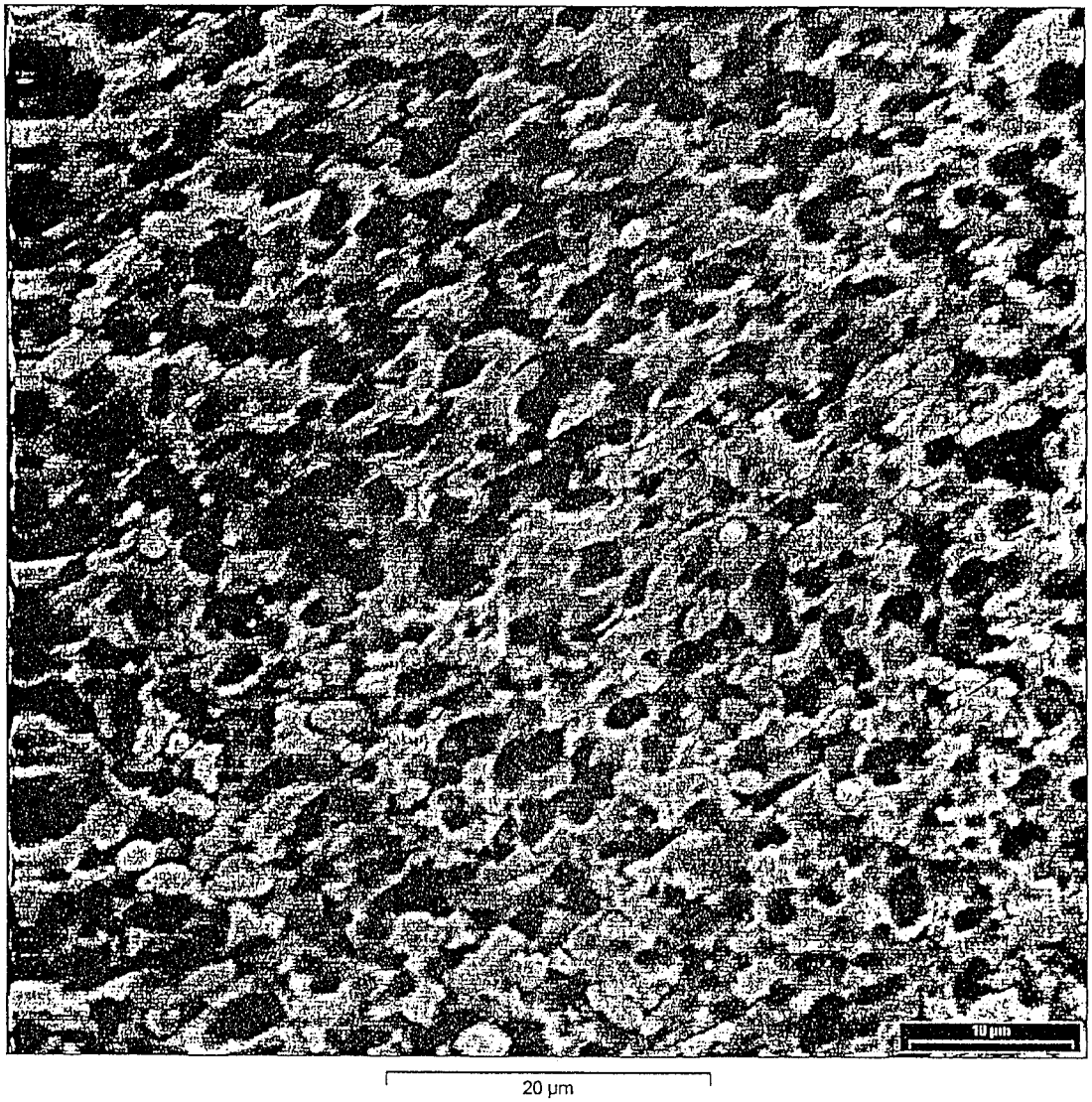

FIGS. 9 and 10

1 pass at 30° to original graining direction 1 pass at the opposite 30° angle

Figure 11:
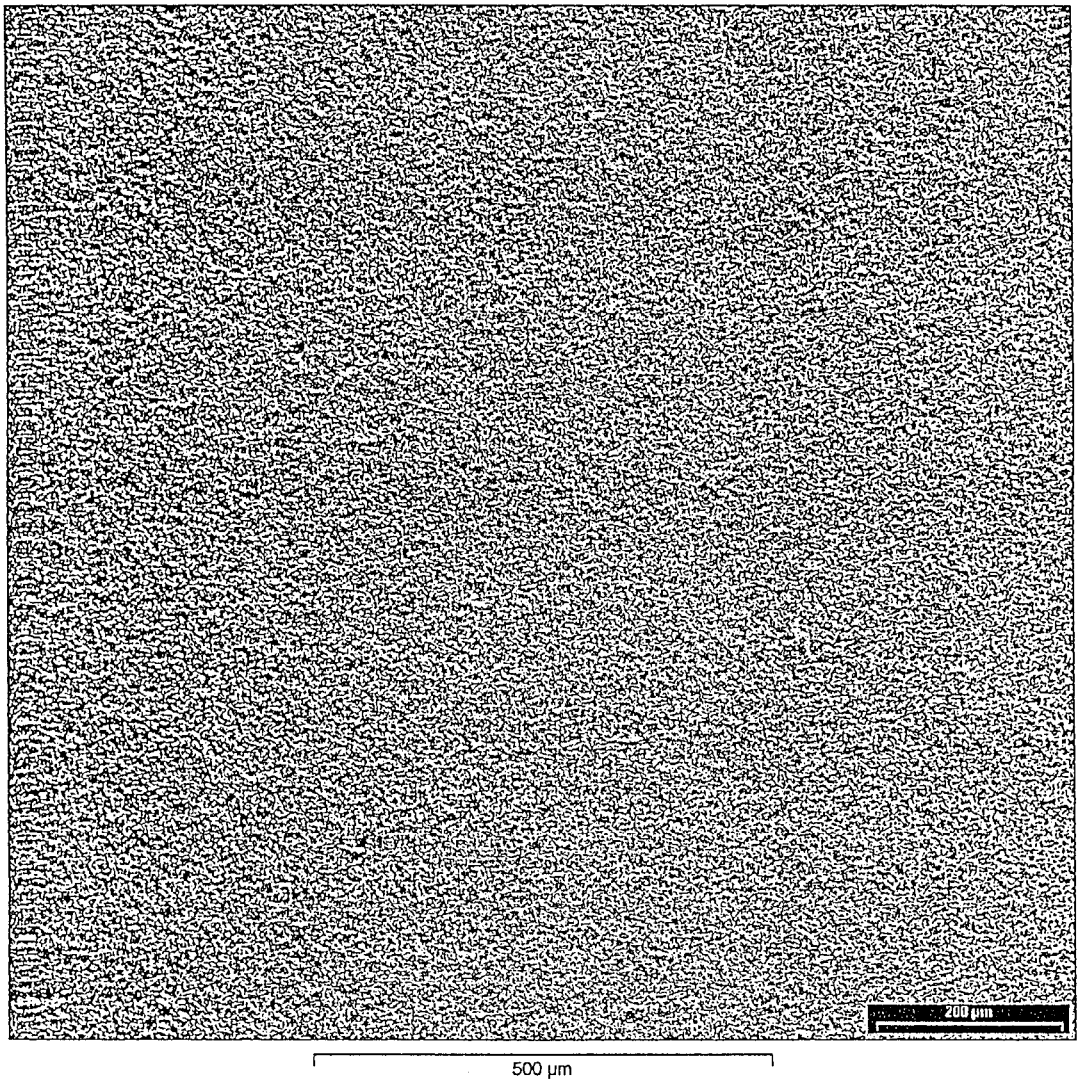
Figure 12:
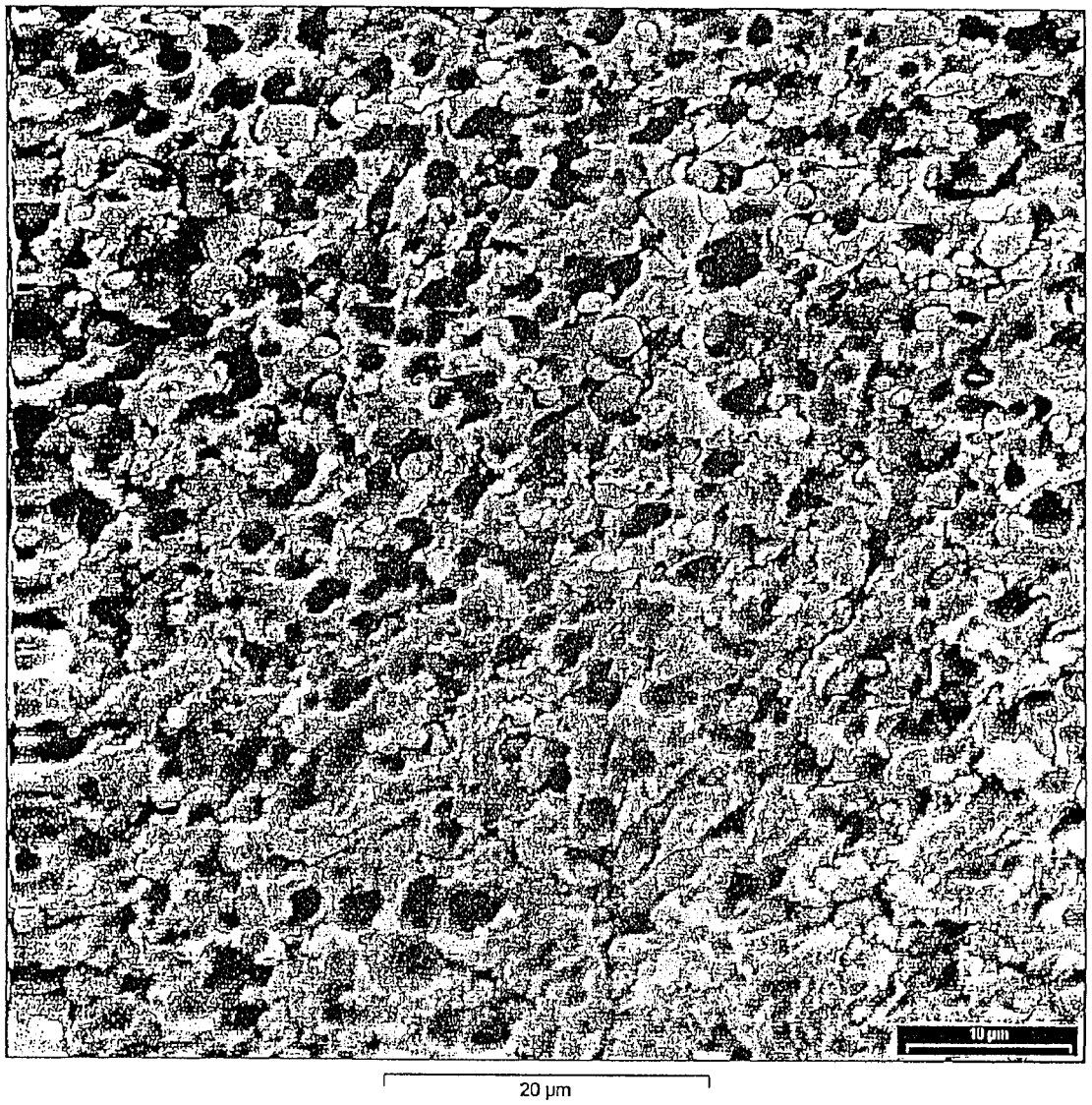

FIGS. 11 and 12

1 pass at 15° to original graining direction 1 pass at the opposite 15° angle

Figure 13:
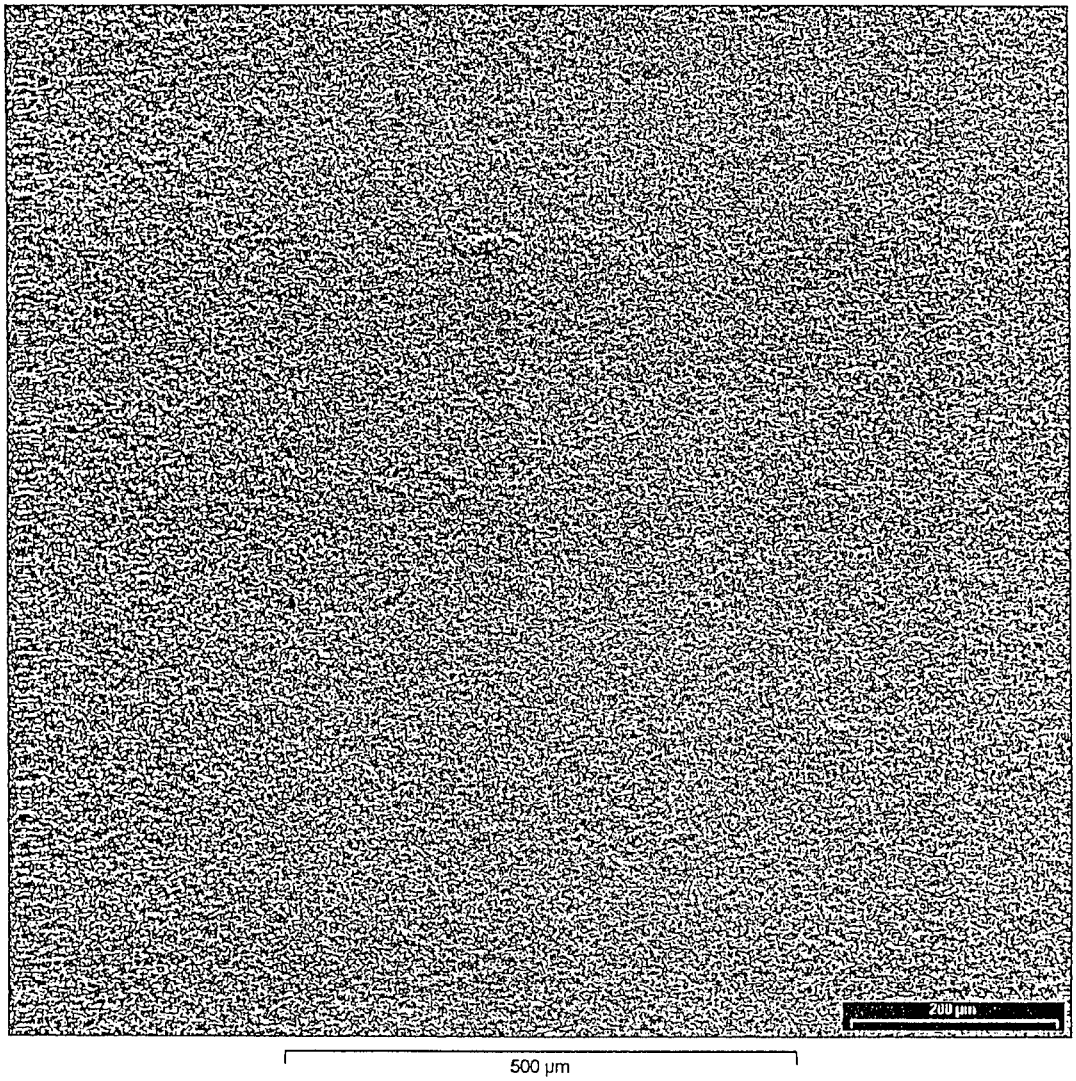
Figure 14:
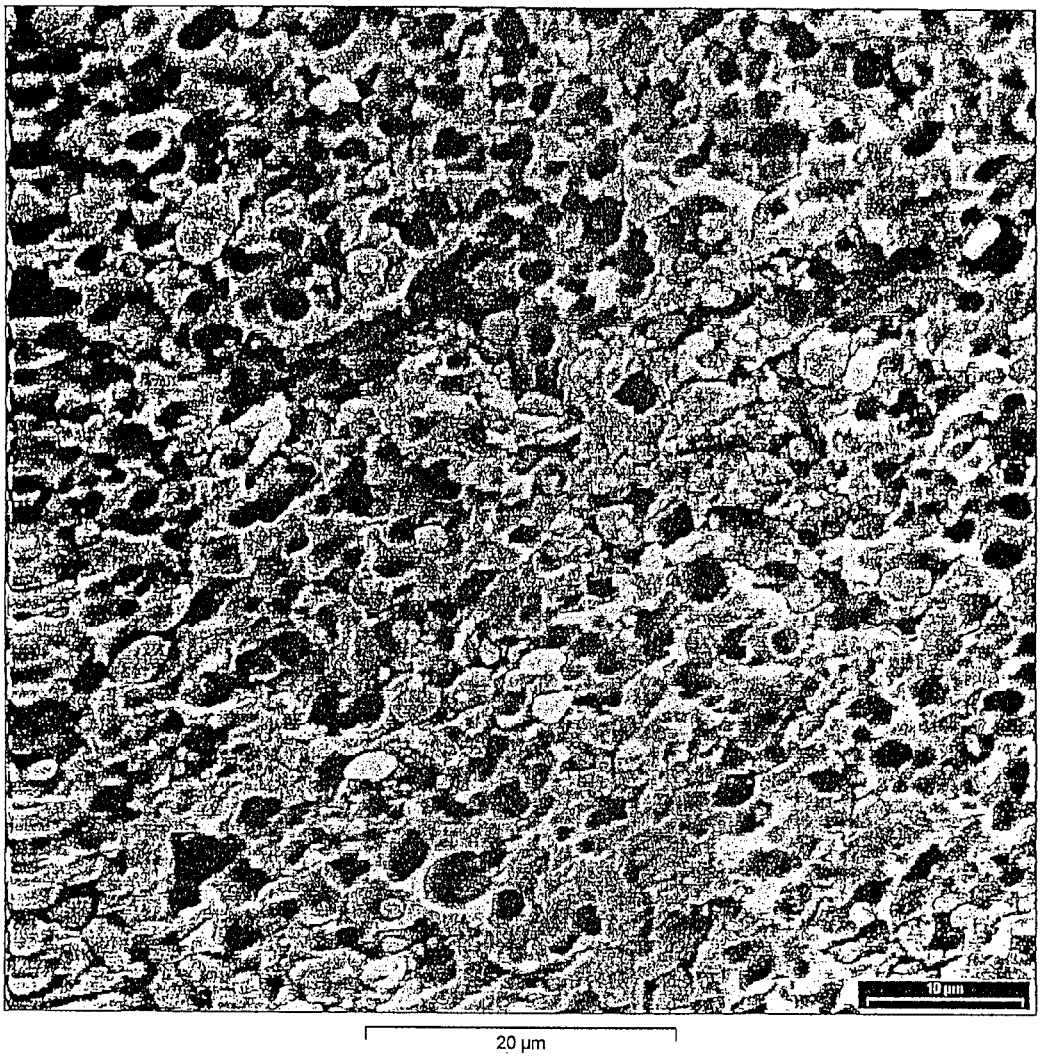

FIGS. 13 and 14

1 pass at 5° to original graining direction 1 pass at the opposite 5° angle

In the micrographs of FIGS. 7 to 14 there are no longer the visible striations indicating that the angled brush graining of the invention has removed the striations.

This has resulted from the present invention in which there is brush graining with the bristles of one or more brushes moving over the web along a first track and the bristles of one or more additional brushes moving over the web along one or more second tracks at angles to the first track and also optionally at angles to each other. The second track or tracks are at an angle of at least 5° with respect to the first track and up to 175° if one or more brushes have bristles rotating generally in a direction opposite to the direction of travel of the web.

What is claimed is:

1. A method of preparing a substrate for lithographic printing plates comprising brush graining a web of aluminum lithographic printing plate substrate material moving along a path having a slurry of graining particles thereon wherein said brush graining comprises:

a. brush graining with at least one graining brush having bristles moving along a first track over said moving web; and b. brush graining with at least one additional graining brush having bristles moving along a second track over said moving web at an angle of at least 5° to said first track.

2. A method as recited in claim 1 wherein said first track is along said path.

3. A method as recited in claim 1 wherein both said first track and said second track are at angles to said path.

4. A method as recited in claim 3 wherein said brush graining in said first track comprises rotary brush graining.

5. A method as recited in claim 3 wherein both said brush graining along said first track and said brush graining along said second track comprise rotary brush graining.

6. A method as recited in claim 1 wherein at least one of said graining brushes comprises a flexible belt having brush bristles extending therefrom.

7. A method as recited in claim 2 wherein said second track is at an angle between 5° and 90° to said first track.

8. A method as recited in claim 5 wherein said brush graining along said first track comprises rotary brush graining with at least one rotary brush having an axis of rotation extending transversely across said path.

* * * * *